US008561725B2

(12) United States Patent
Wilde et al.

(10) Patent No.: US 8,561,725 B2
(45) Date of Patent: Oct. 22, 2013

(54) ULTRA-HARD DRILL COLLAR

(76) Inventors: David Wilde, Houston, TX (US); James Shamburger, Spring, TX (US)

( * ) Notice: Subject to any disclaimer, the term of this patent is extended or adjusted under 35 U.S.C. 154(b) by 191 days.

(21) Appl. No.: 12/590,429

(22) Filed: Nov. 6, 2009

(65) Prior Publication Data

US 2011/0108328 A1 May 12, 2011

(51) Int. Cl.
*E21B 17/00* (2006.01)

(52) U.S. Cl.
USPC ..... 175/320; 175/325.2; 175/73; 164/76.1; 164/97

(58) Field of Classification Search
USPC ..... 175/320; 164/76.1, 97
See application file for complete search history.

(56) References Cited

U.S. PATENT DOCUMENTS

| | | | | |
|---|---|---|---|---|
| 5,251,708 | A * | 10/1993 | Perry et al. | 175/41 |
| 5,297,640 | A * | 3/1994 | Jones | 175/73 |
| 6,758,530 | B2 * | 7/2004 | Sollami | 299/111 |
| 2006/0266555 | A1 * | 11/2006 | Chen et al. | 175/61 |
| 2009/0008151 | A1 * | 1/2009 | Turner et al. | 175/45 |
| 2010/0116551 | A1 * | 5/2010 | Southard | 175/45 |
| 2010/0139987 | A1 * | 6/2010 | Hunt et al. | 175/369 |

* cited by examiner

*Primary Examiner* — Yong-Suk (Philip) Ro

(57) ABSTRACT

A drill collar formed substantially entirely from a metal matrix material and one or more metal alloys, the drill collar being produced through a molding process. The metal matrix material of the drill collar minimizes lateral movement and vibration during drilling operations, while providing a weight greater than that of conventional drill collar materials, thereby enabling construction of drill collars and bottom hole assemblies having a reduced length.

12 Claims, 3 Drawing Sheets

38

ULTRA-HARD DRILL COLLAR

CROSS REFERENCE TO RELATED APPLICATIONS

The present application claims priority to the copending U.S. patent application Ser. No. 12/313,130, filed Nov. 17, 2008, the entirety of which is incorporated herein by reference.

FIELD OF THE INVENTION

The present invention relates, generally, to drill collars and similar tubular elements within a drilling string and/or bottom hole assembly, formed from an ultra-hard metal matrix material to minimize lateral movement and vibration of the drill collar during drilling, and methods for forming such drill collars.

BACKGROUND OF THE INVENTION

It is well known in the art of drilling oil and gas wells to secure drill collars within or adjacent to the bottom hole assembly of a drilling string, above the drill bit. Typically, a drill collar is a heavy, thick-walled, tubular component, used to provide weight to the drill bit such that the drill bit exerts sufficient downward force to penetrate a formation. The weight and thickness of drill collars also reduces the effect of vibrations caused by drilling on the bottom hole assembly, maintaining stability and reducing undesired directional deviation. Conventional drill collars are formed from steel bars, machined to a desired size, shape, and finish, through which a longitudinal bore is drilled to enable the flow of drilling fluid therethrough. A standard drill collar is approximately thirty feet in length, and a standard bottom hole assembly, which includes multiple drill collars, is generally three hundred feet in length.

Due to the potential for interference from ferrous metals when using logging while drilling and/or measurement while drilling devices, as well as other electrical or magnetic devices, many drill collars are formed from nonmagnetic alloys, such as monel. Often, alternative nonmagnetic materials for drill collars lack the strength of high carbide steel and rapidly become worn. Steel drill collars are also hindered by a limited usable life. Once worn, drill collars cannot normally be repaired and must be machined to a smaller diameter to enable reuse with a smaller bottom hole assembly within a smaller well bore. Drill collars worn or damaged beyond use must be discarded and replaced, significantly increasing the cost of downhole operations. To enhance wear resistance, drill collars can be provided with hardfacing, or with inserts having hardfacing thereon, the inserts being welded or otherwise attached to the drill collar. However, the limited usable life of drill collars remains a difficulty in the industry, as all drill collars, even when hardfaced, are prone to wear and damage during use.

The wear experienced by a drill collar is exacerbated by the length of the collar and correspondingly, the length of the bottom hole assembly. Due to the proximity of the outer diameter of a bottom hole assembly to the wall of a well bore, a narrow region of annular space exists along the length of the assembly, which results in a high velocity, turbulent fluid flow directly adjacent thereto. The large length required for a bottom hole assembly to provide sufficient weight to a drill bit results in prolonged exposure of the assembly to this high velocity annular fluid. The turbulent fluid flow can quickly increase wear to many components of the bottom hole assembly, including drill collars, and can also increase the potential for directional instability or undesired deviation.

Additionally, during drilling operations, it is common for drill pipe to experience lateral sway and vibrations, especially at great depths, due to the yield of the drill pipe. These vibrations are transferred to adjacent drill collars and other components of the bottom hole assembly. Vibrations are released from a drilling string at the point where the drill pipe connects to a thicker and less flexible drill collar. While drill collars generally yield less than drill pipe, conventional steel and monel drill collars are still prone to lateral movement and vibration. Due to the proximity of the bottom hole assembly to the well bore wall, under extreme conditions, conventional drill collars can be caused to yield sufficiently to contact the well bore, which can damage the drill collar or other components of bottom hole assembly or cause the bottom hole assembly to become stuck. Excessive vibration and/or yielding of the drill collars can also cause the drill bit to be lifted from the bottom of the well bore, causing ineffective and/or intermittent drilling. This difficulty is enhanced by the three hundred foot length of a conventional bottom hole assembly, as a lengthy assemblage of drill collars is more prone to yield and lateral movement than a shorter bottom hole assembly.

Further, when drilling through strata of varying pressures, such as alternating sand, shale, and/or rock layers, it is common for regions of lower formation pressure to create a vacuum, which can pull the bottom hole assembly toward the well bore wall. The bottom hole assembly is affected by such a vacuum during the duration of its passage through a region of strata having a pressure differing from that of an adjacent region of strata. Thus, the overall length of the bottom hole assembly can exacerbate the detrimental affects of differing formation pressure, increasing the likelihood of the bottom hole assembly becoming damaged or stuck.

A need exists for a drill collar that overcomes the deficiencies of conventional drill collars by resisting wear, vibration, and lateral movement and vibrations, thereby improving the useful life of the drill collar while minimizing the incidence or occurrence for an associated bottom hole assembly to impact the well bore wall or otherwise become damaged or stuck.

A need also exists for a drill collar that surpasses the limitations of conventional materials, enabling use of non ferromagnetic drill collars having a shorter length than conventional drill collars, subsequently allowing for creation of bottom hole assemblies having a significantly reduced length.

DETAILED DESCRIPTION OF THE PREFERRED EMBODIMENTS

Figure 1A:
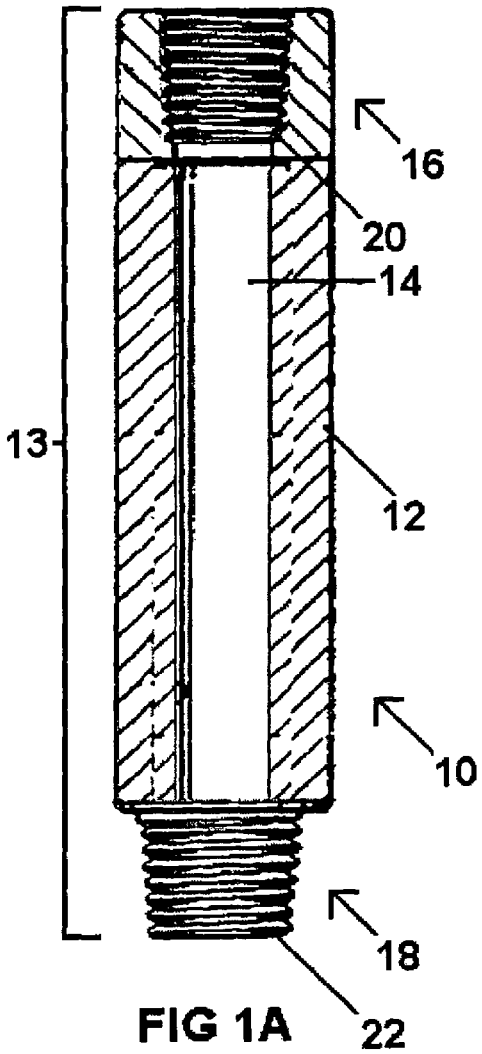
FIG. 1A depicts a side cross sectional view of an embodiment of a drill collar usable with the present invention.

The present invention relates, generally to drill collars and similar tubular elements within a drilling string, formed substantially entirely from a metal matrix material and one or more metal alloys. While conventional drill collars are formed from machined bars of steel, monel, or other alloys, embodiments of the present invention have a body formed through a powdered metal infiltration casting process, in which particles of a metal matrix material, such as tungsten carbide, are bound together using one or more metal alloys, such as nickel, cobalt, iron, monel, or other transition metals as a binding material.

The resulting drill collar is extremely resistant to wear, far exceeding the usable life of conventional and hardfaced drill collars. Further, the drill collar is generally nonmagnetic, enabling use of measurement while drilling, logging while drilling devices, and/or similar electrical or magnetic components adjacent thereto. Additionally, the body of a tungsten carbide matrix drill collar, or that of a similar metal matrix material, is extremely resistant to yield and vibration, eliminating nearly all lateral motion and vibration propagated to the drill collar from the drill pipe during drilling operations.

Most notably, due to the fact that tungsten carbide and similar metal matrix materials have a weight approximately two and one half times that of steel, embodiments of the present drill collar can apply sufficient weight to a drill bit to enable penetration while being provided with a shorter length than that of conventional thirty foot drill collars. In an embodiment of the invention, the drill collar can have a length of approximately twelve feet, enabling use of bottom hole assemblies having a length far less than that of conventional three hundred foot assemblies, such as one hundred to two hundred feet. In addition to a significant reduction in the cost and time associated with formation and use of a bottom hole assembly, use of a shorter assembly reduces the negative effects of turbulent annular flow and differential formation pressure by providing a smaller area on which such detrimental forces can act.

In an embodiment of the invention, the drill collar can be formed using a powdered metal infiltration casting process. A mold having a shape adapted to form a drill collar is packed and/or otherwise provided with a powdered metal matrix material, while pieces of one or more selected metal alloys are placed in fluid communication with the metal matrix material, such as through use of a separate chamber having a bore, funnel, or similar connecting member in communication with the mold. The one or more metal alloys are then melted, which can be accomplished by placing the mold into a furnace and heating the mold in excess of the melting point of the one or more metal alloys. Due to the generally elongate shape of the drill collar and corresponding mold, in an embodiment of the invention, the mold can be placed into a furnace in a horizontal orientation. Formation of drill collars having a length less than that of conventional drill collars thereby enables use of smaller, less expensive furnaces or other heating devices. Once melted, the molten metal alloys are drawn into the spaces between particles of the packed powdered metal matrix material through capillary action. Once cooled through a controlled process, the metal alloys harden between matrix particles to form the body of the drill collar.

After removal from the mold, the drill collar can then be machined to a selected size, shape, and/or finish. The drill collar can further be provided with end pieces welded or otherwise secured to the body, the end pieces being formed from materials other than the metal matrix, such as steel or another metal. The end pieces can be provided with box and pin ends, or other varieties of threaded sections, for enabling the drill collar to be secured to adjacent components. In an embodiment of the invention, the body of the collar can be directly provided with box and pin ends and/or other threaded sections without use of end pieces.

Conventionally, powdered metal infiltration casting processes are used exclusively for production of drill bit bodies, the expense of the materials and the process and the characteristics of the metal matrix material being generally regarded as unsuitable for drill collars and other downhole components. However, drill bit bodies require use of high quality powdered tungsten carbide and metal alloys due to the operational requirements of the drill bit, while drill collars are relatively simple, tubular components having a bore, that are provided to a drill string for weight and stability. As a result, embodiments of the present drill collar can be formed using waste tungsten carbide, such as that produced during grinding or machining of other tungsten carbide components, or similar coarse, waste, and/or otherwise irregular metal matrix materials.

Additionally, formation of the drill collar through a molding process enables the drill collar to be provided with a variety of shapes that would normally require a significant quantity of machining and other laborious processes to produce. While drill collars are typically provided with a cylindrical shape, in various embodiments of the present invention, the drill collar can have a spiral cast shape, or a selected polygonal prismatic shape, such as a rectangular, triangular, hexagonal, or octagonal prism.

Furthermore, unlike most conventional drill collars, a drill collar formed from a metal matrix material can be repaired without altering the shape or dimensions of the drill collar. While embodiments of the present invention, once worn or damaged, can be ground or machined to a smaller diameter, it is also possible to provide powdered metal matrix material to a crack or worn area of the drill collar, and one or more metal alloys in fluid communication with the metal matrix material, similar to the molding process by which the drill collar was formed. The metal alloys can then be melted, enabling the molten alloys to flow into the metal matrix material within the crack or worn area. After cooling, the metal alloys harden, thereby repairing the matrix of the drill collar body.

In addition to a bore extending through the body for permitting the flow of drilling fluid, the drill collar can also be provided with one or more channels through the body for accommodating conductors, which can include any manner of cable, wiring, or other transmission elements. Such channels can be generally straight, while the drill collar body is provided with a second channel on the opposing side or is otherwise weighted to prevent imbalance and instability during drilling. Alternatively, one or more channels for accommodating conductors can be spiraled or otherwise spaced about the drill collar body to prevent imbalance. Conventional drill collars often hinder the use of various electrical components and data transmission devices, such as Intellipipe® systems, as most signals cannot be transmitted through a thick-walled drill collar and require external wires or similar components that are prone to damage during drilling operations.

In an embodiment of the invention, the drill collar can be provided with such bores, channels, and/or other areas devoid of metal matrix material that extend through the drill collar body through use of spacer elements, which can include a metal tube, such as a segment of copper tubing, filled with sand or a similar particulate material that will not melt during the molding process. During the molding process, the metal tube can melt into the powdered metal matrix material, while the sand or other particulate material remains within the stabilizer body, defining a bore or channel. After the molding process, the sand or other particulate material can be readily removed from the drill collar body.

While powdered metal infiltration casting processes are typically performed using graphite molds, due primarily to the low coefficient of expansion of graphite when heated and the ability to machine graphite to form desired mold shapes, in an embodiment of the invention, a hybrid molding method can be used that incorporates use of a reusable shell formed from a generally rigid material, such as graphite, having an interior that can be provided with an inexpensive, easily-machined, fusible material, such as foundry sand, which is usable to form a mold. Resin-bonded foundry sand, or a similar fusible material, can be provided into the shell, then heated to approximately 250 to 450 degrees Fahrenheit to cause the resin to at least partially melt, thereby causing the particles of sand to adhere together to form a fused solid insert within the shell. The fused material is more easily machined than graphite, while costing significantly less. The cost of graphite molds can become significant, as it is often necessary to destroy a graphite mold to remove the molded object therefrom.

Embodiments of the present drill collar are usable to form bottom hole assemblies having a length less than that of conventional assemblies, the bottom hole assemblies incorporating one or more drill collars formed from a metal matrix material, as described previously. Usable bottom hole assemblies can include any number of drill collars directly above and/or below a measurement while drilling and/or logging while drilling device, if used, as embodiments of the present drill collar can be generally nonmagnetic. Data transmission components are also usable, as described previously, through incorporation of channels within one or more drill collars for accommodating conductors.

As vibrations from drill pipe are propagated to an adjacent bottom hole assembly, these vibrations can laterally exit the drill string. When the yield of a drill collar directly adjacent to the drill pipe is significantly less than that of the drill pipe, it is possible that under extreme conditions, the connection between the drill pipe and the bottom hole assembly may break. In an embodiment of the invention, a transition collar having a yield less than that of a metal matrix drill collar, and a yield greater than that of the drill pipe, can be provided directly adjacent to the drill pipe. For example, a monel or steel drill collar can be inserted between the drill pipe and a metal matrix drill collar to gradually dissipate vibrations from the drill pipe as the vibrations are transferred to the bottom hole assembly.

Referring now to FIG. 1A, a side cross sectional view of an embodiment of a drill collar (10) usable within the scope of the present invention is depicted. The drill collar (10) is shown having a generally cylindrical body (12). It should be noted that while FIG. 1A depicts the body (12) having a generally cylindrical shape, a drill collar having any desired shape is usable within the scope of the present invention.

While conventional drill collars include bodies formed from steel, monel, or other machined metals, the body (12) of FIG. 1 can be formed substantially entirely from a metal matrix material, such as tungsten carbide, through a molding process, such as powdered metal infiltration casting, as described previously. Due to the increased weight of the metal matrix material, when compared to steel, monel, or other conventional materials for forming drill collars, the depicted drill collar (10) can be provided with a length (13) shorter than that of conventional drill collars. For example, while conventional drill collars have a standard length of about thirty feet, an embodiment of the depicted drill collar (10) can be provided with a length of twelve feet.

The body (12) of the drill collar (10) is shown having a bore (14) extending therethrough for permitting the flow of drilling fluid during drilling operations. The bore (14) can be formed during the molding process, such as through placement of packed sand or a similar spacing element, within the metal matrix material. Alternatively, in an embodiment of the invention, the bore (14) can be formed by grinding, machining, drilling, or otherwise modifying the body (12) after the molding process.

Figure 1B:
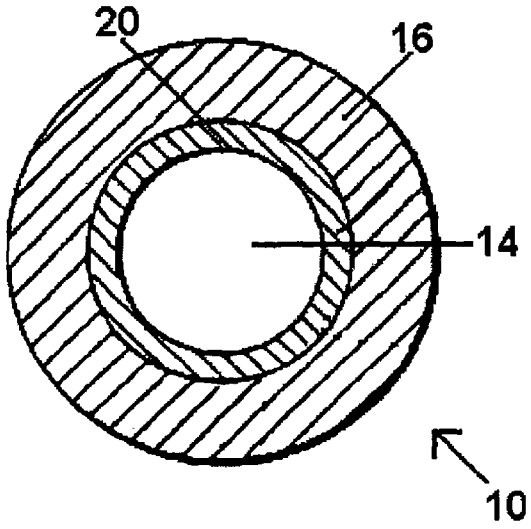
FIG. 1B depicts a top cross sectional view of the drill collar of FIG. 1A.

The depicted drill collar (10) is shown having a first end piece (16) and a second end piece (18) welded or otherwise secured thereto. While the end pieces (16, 18) can be formed from any desired material, in an embodiment of the invention, the end pieces (16, 18) are formed from steel, monel, or another metal other than the metal matrix material of the body (12). The end pieces (16, 18) are usable as connectors for securing the drill collar (10) to adjacent components, including other drill collars. FIG. 1A depicts the first end piece (16) as a box end having interior threads (20), and the second end piece (18) as a pin end having exterior threads (22). FIG. 1B depicts a top cross sectional view of the drill collar (10), in which the first end piece (16), interior threads (20), and bore (14) are visible.

Figure 2:
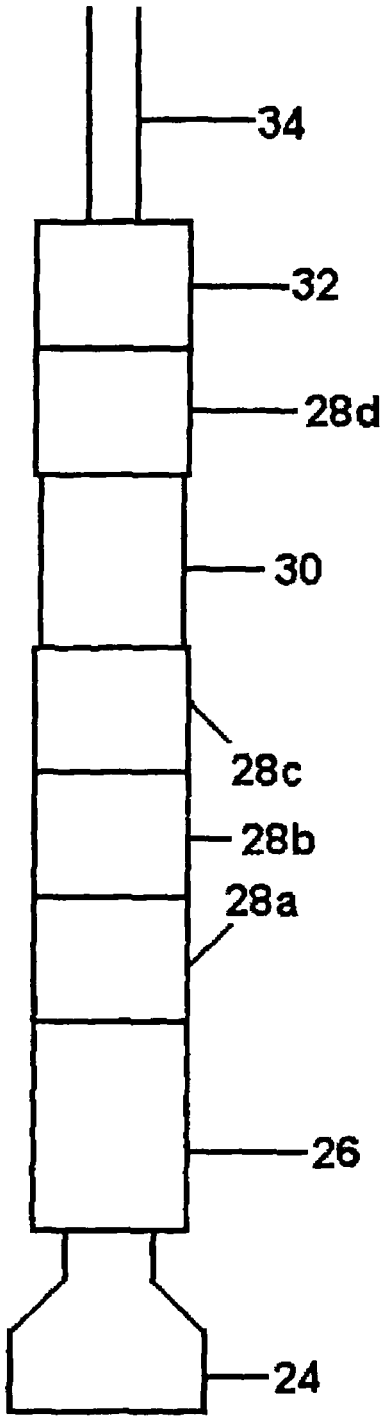
FIG. 2 depicts a schematic view of an embodiment of a bottom hole assembly usable within the present invention.

Referring now to FIG. 2, a schematic diagram of an exemplary bottom hole assembly usable within the scope of the present invention is shown. The bottom hole assembly is depicted having a drill bit (24), which can include any type of drill bit known in the art, such as a PDC bit, a roller or rock bit, or other types of drill bits. Directly adjacent to the drill bit (24), a mud motor (26) can be secured to provide additional power to the drill bit (24) during drilling. The mud motor (26) can include movable rotor and stator components, a transmission housing and bearing housing, and other components as known in the art.

While specific configurations and arrangements of components within a bottom hole assembly can vary, FIG. 2 depicts a series of metal matrix drill collars (28*a*, 28*b*, 28*c*) secured above the mud motor (26). It should be noted what while FIG. 2 depicts the series of metal matrix drill collars (28*a*, 28*b*, 28*c*) using three indicated sections, each indicated section can represent a single drill collar, multiple drill collars, or combinations thereof. The number of drill collars included in a bottom hole assembly can vary depending on the weight and length required for a desired drilling operation.

A measurement while drilling device (30), or similar orienting apparatus, is shown secured within the bottom hole assembly adjacent to the series of metal matrix drill collars (28*a*, 28*b*, 28*c*). An additional series of metal matrix drill collars (28*d*) is shown secured to the opposing end of the measurement while drilling device (30). Due to the generally nonmagnetic nature of the metal matrix drill collars (28*a*, 28*b*, 28*c*, 28*d*), unimpeded use of a measurement while drilling device (30) or similar electrical and/or magnetic component immediately adjacent thereto is possible.

A transition drill collar (32) is shown secured between the additional series of metal matrix drill collars (28*d*) and the drill pipe (34). The transition drill collar (32) can be formed from one or more materials that will yield less than the drill pipe (34) during drilling operations, but more than the metal matrix drill collars (28*a*, 28*b*, 28*c*, 28*d*). Use of a transition drill collar (32) ensures that vibrations transferred from the drill pipe (34) to the bottom hole assembly do not immediately dissipate when propagated through the additional series of metal matrix drill collars (28*d*), which could potentially damage the connection between the drill pipe (34) and the bottom hole assembly.

The connection between the drill pipe (34) and the transition drill collar (32) can include any type of connectors, subs, bearings, seals, valves, or other components as known in the art. Further, it should be noted that the depicted schematic diagram of FIG. 2 is an exemplary embodiment, and that any of the depicted components can include various connectors, subs, bearings, seals, valves, or other components therebetween, and that the depicted components can be otherwise arranged, certain depicted components can be omitted, or additional components can be added depending on the requirements of a selected drilling operation.

Figure 3A:
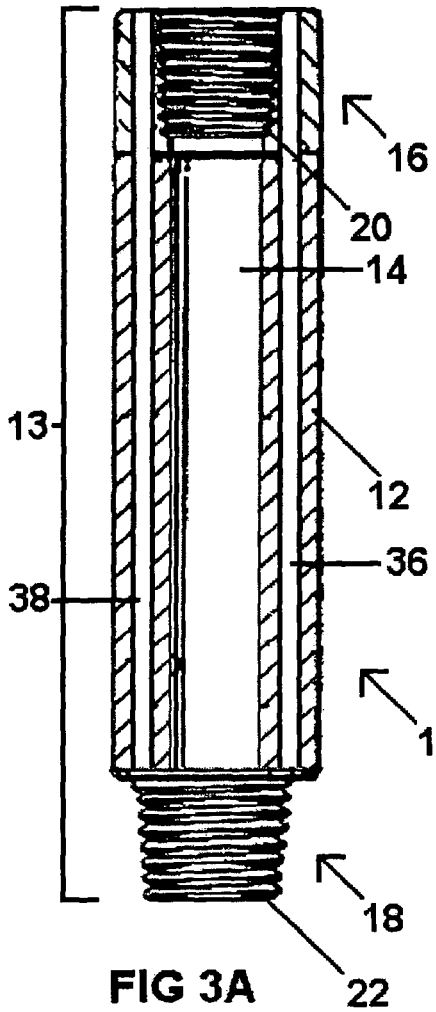
FIG. 3A depicts a side cross sectional view of an alternate embodiment of a drill collar usable with the present invention.

Referring now to FIG. 3A a side cross sectional view of an alternative embodiment of the drill collar (10) of FIG. 1A is depicted, having the generally cylindrical body (12) with a bore (14) therethrough, and first and second end pieces (16, 18) attached thereto with interior and exterior threads (20, 22), the body having a selected length (13).

Figure 3B:
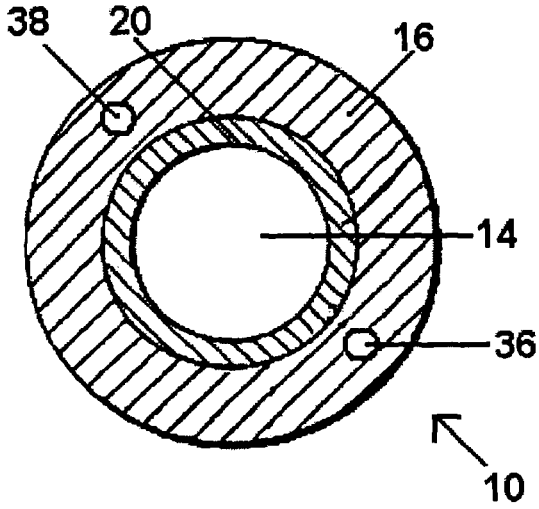
FIG. 3B depicts a top cross sectional view of the drill collar of FIG. 3A.

Additionally, FIG. 3A depicts a first channel (36) and a second channel (38) formed through the body (12), the channels (36, 38) being usable to accommodate conductors from data transmission devices and/or other electrical elements. While FIG. 3A depicts two channels (36, 38) extending through the body (12) in a generally straight orientation, each channel being disposed on opposing sides of the body (12) to prevent the unbalancing of the drill collar (10), it should be understood that the body (12) of the drill collar (10) can be provided with any number of channels having any shape or orientation. For example, one or more channels could extend through the body (12) in a spiraled orientation to prevent the channels from creating an imbalance in the drill collar (10). FIG. 3B depicts a top cross sectional view of the drill collar (10), in which the first end piece (16), interior threads (20), bore (14), and first and second channels (36, 38) are visible.

The present invention thereby provides for drill collars that overcome the deficiencies of conventional drill collars, related methods of forming such drill collars, and bottom hole assemblies that include such drill collars. The embodied drill collars are generally nonmagnetic, resist wear and possess a usable life in excess of drill collars formed from other materials, and are nearly entirely unaffected by lateral movement and vibrations imparted by drilling operations, thereby significantly reducing the possibility of a bottom hole assembly becoming damaged, stuck, or otherwise deviating directionally. Additionally, the embodied drill collars possess a weight greater than that of conventional drill collars, enabling the use of bottom hole assemblies having a length significantly less than a similar assembly constructed using conventional drill collars, thereby reducing the effects of turbulent annular flow and differential formation pressure.

While various embodiments of the present invention have been described with emphasis, it should be understood that within the scope of the appended claims, the present invention might be practiced other than as specifically described herein.

The invention claimed is:

1. A bottom hole assembly comprising a first drill collar in communication with a drilling string and a drill bit, wherein the first drill collar is formed substantially entirely from a metal matrix material comprising a matrix of tungsten carbide particles having at least one metal alloy disposed within spaces between said particles, wherein the first drill collar has a bore extending therethrough for permitting flow of drilling fluids, wherein the first drill collar comprises a first yield strength and the drilling string comprises a second yield strength, and wherein the metal matrix material and the at least one metal alloy minimize lateral movement or vibration of the first drill collar during drilling; and a transition drill collar disposed between the drilling string and the first drill collar, wherein the transition drill collar comprises a third yield strength greater than the first yield strength and less than the second yield strength such that lateral movement and vibration of the drilling string is transferred to the transition drill collar prior to transference of the lateral movement and vibration to the first drill collar, wherein the first drill collar comprises a first channel extending therethrough on a first side of the first drill collar and a second channel on a second side of the first drill collar opposite the first side, and wherein the second channel prevents unbalancing of the first drill collar.

2. The bottom hole assembly of claim 1, wherein the metal matrix material comprises waste tungsten carbide.

3. The bottom hole assembly of claim 1, wherein the at least one metal alloy comprises nickel, cobalt, iron, monel, or combinations thereof.

4. The bottom hole assembly of claim 1, wherein the first drill collar comprises a length less than 30 feet.

5. The bottom hole assembly of claim 1, wherein the first drill collar comprises a length of less than or equal to 12 feet.

6. The bottom hole assembly of claim 1, wherein the first drill collar comprises a polygonal prismatic shape, a spiral cast shape, or combinations thereof.

7. The bottom hole assembly of claim 1, further comprising an end piece secured to the first drill collar, wherein the end piece is formed from a material other than the metal matrix material and one or more metal alloys that form the first drill collar.

8. The bottom hole assembly of claim 7, wherein the end piece comprises a box end, a pin end, or combinations thereof comprising threads for securing the first drill collar to adjacent objects.

9. The bottom hole assembly of claim 1, wherein the bottom hole assembly comprises a length of less than 300 feet.

10. The bottom hole assembly of claim 1, wherein the bottom hole assembly comprises a length of less than or equal to 200 feet.

11. The bottom hole assembly of claim 1, further comprising a data transmission component comprising a conductor extending through the first channel.

12. The bottom hole assembly of claim 1, wherein the first channel extends through the first drill collar in a spiraled orientation to prevent the first channel from creating an imbalance in the drill collar.

* * * * *